US009803843B2

(12) United States Patent
Engelen et al.

(10) Patent No.: US 9,803,843 B2
(45) Date of Patent: Oct. 31, 2017

(54) RETRACTABLE LIGHTING FIXTURE

(71) Applicant: PHILIPS LIGHTING HOLDING B.V., Eindhoven (NL)

(72) Inventors: Dirk Valentinus René Engelen, Heusden-Zolder (BE); Anthonie Hendrik Bergman, Nuenen (NL); Tim Dekker, Eindhoven (NL); Bram Knaapen, Eindhoven (NL); Bartel Marinus Van De Sluis, Eindhoven (NL); Jochen Renaat Van Gheluwe, Lommel (BE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/281,946

(22) Filed: May 20, 2014

(65) Prior Publication Data

US 2014/0254157 A1 Sep. 11, 2014

Related U.S. Application Data

(63) Continuation of application No. 14/237,775, filed as application No. PCT/IB2012/053885 on Jul. 30, 2012.

(Continued)

(51) Int. Cl.
*F21V 7/04* (2006.01)
*F21V 23/04* (2006.01)

(Continued)

(52) U.S. Cl.
CPC ..... *F21V 23/0492* (2013.01); *E04F 10/06* (2013.01); *E06B 9/24* (2013.01); *E06B 9/40* (2013.01); *F21V 21/14* (2013.01); *F21V 33/006* (2013.01); *H05B 33/08* (2013.01); *E04F 10/0611* (2013.01); *E06B 2009/247* (2013.01); *E06B 2009/2458* (2013.01);

(Continued)

(58) Field of Classification Search
CPC ..... G09F 9/301
USPC ..... 362/600–634
See application file for complete search history.

(56) References Cited

U.S. PATENT DOCUMENTS 768,034 A 8/1904 Colburn
4,970,812 A * 11/1990 Tanaka ..... G09F 9/33 40/444

(Continued)

FOREIGN PATENT DOCUMENTS

CN 1588506 A 3/2005
CN 201766759 U 3/2011

(Continued)

*Primary Examiner* — William Carter
(74) *Attorney, Agent, or Firm* — Meenakshy Chakravorty

(57) ABSTRACT

Disclosed is a retractable lighting fixture having a retractable LED lighting layer. One or more optical layers (40, 240A/B, 340A/B, 440) may optionally be provided over the LED lighting layer (30, 230, 330, 430). The optical layer(s) and the LED lighting layer may optionally be movable relative to one another between at least being in an expanded spaced relation to one another and a compressed relation to one another. One or more LEDs (34, 134, 234A/B, 334A/B, 434) on the LED lighting layer may be individually controllable and such LEDs (34, 134, 234A/B, 334A/B, 434) may be selectively extinguished when they are in a retracted position.

17 Claims, 8 Drawing Sheets

Related U.S. Application Data

(60) Provisional application No. 61/522,037, filed on Aug. 10, 2011.

(51) Int. Cl.

| | |
|---|---|
| ***F21V 33/00*** | (2006.01) |
| ***F21V 21/14*** | (2006.01) |
| ***E06B 9/24*** | (2006.01) |
| ***E06B 9/40*** | (2006.01) |
| ***E04F 10/06*** | (2006.01) |
| ***H05B 33/08*** | (2006.01) |
| *F21V 5/02* | (2006.01) |
| *F21V 9/16* | (2006.01) |
| *F21V 15/01* | (2006.01) |
| *E06B 9/264* | (2006.01) |
| *F21V 14/00* | (2006.01) |
| *F21Y 105/10* | (2016.01) |
| *F21Y 115/10* | (2016.01) |
| *F21Y 107/90* | (2016.01) |

(52) U.S. Cl.

CPC ..... *E06B 2009/2643* (2013.01); *F21V 5/02* (2013.01); *F21V 9/16* (2013.01); *F21V 14/006* (2013.01); *F21V 15/012* (2013.01); *F21Y 2105/10* (2016.08); *F21Y 2107/90* (2016.08); *F21Y 2115/10* (2016.08)

(56) References Cited

U.S. PATENT DOCUMENTS

| | | | | |
|---|---|---|---|---|
| 5,986,581 | A | 11/1999 | Magdaleno, II et al. | |
| 6,016,038 | A | 1/2000 | Mueller et al. | |
| 6,211,626 | B1 | 4/2001 | Lys et al. | |
| 6,505,956 | B1 | 1/2003 | Priddy et al. | |
| 7,374,315 | B2 * | 5/2008 | Dorsey | F21S 4/003 362/249.01 |
| 7,682,034 | B2 | 3/2010 | Asvadi et al. | |
| 2005/0219171 | A1 | 10/2005 | Gimbutas | |
| 2008/0010877 | A1 | 1/2008 | Deflin et al. | |
| 2008/0218369 | A1 | 9/2008 | Krans et al. | |
| 2010/0065873 | A1 | 3/2010 | Bhatacharya et al. | |
| 2010/0182766 | A1 | 7/2010 | Lai | |
| 2010/0302779 | A1 * | 12/2010 | Chemel | F21S 4/28 362/249.02 |
| 2011/0227822 | A1 * | 9/2011 | Shai | G06F 1/1615 345/156 |
| 2013/0038584 | A1 * | 2/2013 | Burgin | G09F 9/30 345/205 |
| 2013/0083558 | A1 * | 4/2013 | Becze | G06F 3/1438 362/611 |

FOREIGN PATENT DOCUMENTS

| | | | |
|---|---|---|---|
| DE | 202009006935 | U1 | 10/2009 |
| JP | 2009146672 | A | 7/2009 |
| JP | 2009176633 | A | 8/2009 |
| JP | 2010231952 | A | 10/2010 |
| WO | 2005099310 | A2 | 10/2005 |
| WO | 2010058360 | A1 | 5/2010 |

* cited by examiner

RETRACTABLE LIGHTING FIXTURE

TECHNICAL FIELD

The present invention is directed generally to LED-based lighting fixtures. More particularly, various inventive methods and apparatus disclosed herein relate to a lighting fixture having a retractable LED lighting layer.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626.

Lighting fixtures implementing LEDs may include LEDs embedded within a flexible sheet of material such as, for example, a flexible textile, flexible printed circuit board, and/or other flexible sheet of material. The LEDs may be powered and optionally controlled via power and control connections that may also optionally be incorporated into the flexible sheet of material.

Although such lighting fixtures implement LEDs in a flexible sheet of material, they may suffer from one or more drawbacks. For example, such lighting fixtures may not provide for retractability of the flexible sheet of material. Also, for example, the LEDs in the flexible sheet of material may be visible as light-dots in the flexible sheet of material—which may not be desired in certain situations. For example, in some situations it may be desirable to mix the light from a plurality of LEDs of different colors to create a uniform color or gradually changing color gradient. Also, for example, in some situations it may be desirable to create a diffuse lighting effect.

Thus, there is a need in the art to provide a lighting fixture that employs a retractable LED lighting layer and that may optionally overcome one or more drawbacks associated with existing lighting fixtures.

SUMMARY

The present disclosure is directed to inventive methods and apparatus for LED-based lighting fixtures. For example, in various embodiments, a retractable lighting fixture is provided having a retractable LED lighting layer. In some embodiments, one or more optical layers may be provided over the LED lighting layer and be retractable therewith. The optical layers and the LED lighting layer may optionally be movable relative to one another between at least being in an expanded spaced relation to one another and a compressed relation to one another. In some embodiments, one or more LEDs on the LED lighting layer may be individually controllable and such LEDs may be selectively extinguished when they are in a retracted position.

Generally, in one aspect, the invention relates to a retractable lighting fixture that includes a lighting fixture housing and a flexible multilayer lighting sheet retractably retainable within the lighting fixture housing. The multilayer lighting sheet is movable between a retracted position at least partially retracted within the lighting fixture housing and an extended position more protracted from the lighting fixture housing than the retracted position. The multilayer lighting sheet has a LED layer and an optical layer over the LED layer. The LED layer includes a plurality of LEDs selectively generating a light output and the optical layer intersects and transmits at least some of the light output. Portions of the LED layer and the optical layer are in an expanded spaced relation to one another when in the extended position and in a compressed relation to one another when in the retracted position. The distance between the LED layer and the optical layer in the expanded spaced relation is at least two times the distance between the LED layer and the optical layer in the compressed relation.

In some embodiments, the LED layer and the optical layer are in contact in the compressed relation. The distance between the LED layer and the optical layer in the expanded spaced relation may be at least four times the distance between the LED layer and the optical layer in the compressed relation.

In some embodiments, the lighting fixture further includes a plurality of resiliently expandable and contractible structures interposed between the LED layer and the optical layer. The structures are in a biased expanded state when portions of the LED layer and the optical layer adjacent thereto are in the expanded spaced relation to one another. In some versions of those embodiments, the structures include foam bars.

The lighting fixture may further include a mandrel within the retracted lighting fixture housing. The multilayer lighting sheet may be coupled to the mandrel and rotated therearound in the retracted position.

The lighting fixture may further include a pair of rollers proximal an entrance to the retracted lighting fixture housing. The rollers may flank and contact the multilayer lighting sheet when the LED layer and the optical layer are moving from the extended position to the retracted position.

In some embodiments, the optical layer includes a phosphor.

In some embodiments, the multilayer lighting sheet further includes a reflecting layer over the LED layer on an opposite side of the LED layer than the optical layer. In some versions of those embodiments the light output of some of the LEDs is primarily directed at the reflecting layer.

Generally, in another aspect, the invention relates to a retractable lighting fixture that includes a housing and a flexible multilayer lighting sheet retractably retainable within the lighting fixture housing. The multilayer lighting sheet is movable between a retracted position at least partially retracted within the lighting fixture housing and an extended position protracted from the lighting fixture housing more than the retracted position. The multilayer lighting sheet has a LED layer and a diffusing optical layer over the LED layer. Portions of the LED layer and the optical layer are in an expanded spaced relation to one another when in the extended position and in a compressed relation to one another when in the retracted position. The lighting fixture further includes a plurality of resilient interspacing structures interposed between the LED layer and the optical layer. The interspacing structures are in an expanded state when the LED layer and the optical layer adjacent thereto are in the expanded spaced relation and in a contracted state when the LED layer and the optical layer adjacent thereto are in the compressed relation.

In some embodiments, the LED layer and the optical layer are in contact in the compressed relation. The distance between the LED layer and the optical layer in the expanded spaced relation may be at least three times the distance between the LED layer and the optical layer in the compressed relation.

In some embodiments, the interspacing structures are non-biased. In some embodiments, the interspacing structures include springs.

In some embodiments, the multilayer lighting sheet includes a diffusing second optical layer over the LED layer. The second optical layer may be on an opposite side of the LED layer than the optical layer. In some versions of those embodiments portions of the LED layer and the second optical layer are in a second optical layer expanded spaced relation to one another when in the extended position and in a second optical layer compressed relation to one another when in the retracted position.

In some embodiments, the LED layer includes LEDs on each side thereof.

The lighting fixture may further include a mandrel within the retracted lighting fixture housing. The multilayer lighting sheet may be coupled to the mandrel and rotated therearound in the retracted position.

In some embodiments, the lighting fixture further includes a pair of rollers proximal an entrance to the retracted lighting fixture housing, the rollers flanking and contacting the multilayer lighting sheet when the LED layer and the optical layer are moving from the extended position to the retracted position.

Generally, in another aspect, the invention relates to a retractable lighting fixture that includes a housing and a flexible LED lighting sheet retractably retainable within the housing. The LED lighting sheet is movable between a retracted position at least partially retracted within the lighting fixture housing and an extended position protracted from the lighting fixture housing more than the retracted position. The LED lighting sheet has a plurality of LEDs selectively electrically connected to a power supply, such as, for example, a current limiting power supply. The lighting fixture further includes a plurality of electrical switches. Each of the switches is electrically interposed between at least one of the LEDs and the power supply and is actuable between at least a first state and a second state. In the first state each of the switches enables electrical interconnectivity between the power supply and LEDs associated therewith. In the second state each of the switches prevents electrical interconnectivity between the power supply and LEDs associated therewith. Each of the switches is in the first state when LEDs associated therewith are protracted from the lighting fixture housing and each of the switches is in the second state when LEDs associated therewith are retracted within the lighting fixture housing.

In some embodiments, the lighting fixture further includes a controller in electrical communication with the switches and individually directing the switches between the first state and the second state. In some versions of those embodiments the lighting fixture further includes at least one sensor in electrical communication with the controller. The sensor may sense the position of the LED lighting sheet. In some embodiments, the sensor is a hall effect sensor. In some versions of those embodiments, the lighting fixture further includes a mandrel within the retracted lighting fixture housing, the LED lighting sheet is coupled to the mandrel and rotated therearound in the retracted position, and the hall effect sensor senses revolutions of the mandrel. In some other embodiments the sensor includes a plurality of photo sensors coupled to the LED lighting sheet.

In some embodiments, at least some of the switches each include structure moving a respective of the switches into the first state when LEDs associated therewith are protracted from the lighting fixture housing and into the second state when LEDs associated therewith are retracted within the lighting fixture housing.

Generally, in yet another aspect, the invention relates to a retractable lighting fixture that includes a housing and a flexible LED lighting sheet retractably retainable within the housing. The LED lighting sheet is movable between a retracted position at least partially retracted within the lighting fixture housing and an extended position protracted from the lighting fixture housing more than the retracted position. The LED lighting sheet has a plurality of LEDs selectively electrically connected to a power supply and electrically connected in a plurality of distinct individually actuable groups. Each of the groups include at least a single of the LEDs and is lightable and extinguishable independently of other of the groups. A controller is in electrical communication with each of the groups and selectively lights and extinguishes each of the groups. The controller causes each of the groups to be extinguished when the LEDs associated therewith are retracted within the lighting fixture housing.

In some embodiments, the controller is in electrical communication with a plurality of switches, each of which interfaces with one of the groups. In some versions of those embodiments the switches are opened when the LEDs associated therewith are extinguished.

The lighting fixture further includes at least one sensor in electrical communication with the controller and sensing the position of the LED lighting sheet.

In some embodiments, the sensor includes a Hall Effect sensor. In other embodiments, the sensor includes a plurality of photo sensors coupled to the LED lighting sheet.

The lighting fixture may further include a mandrel within the retracted lighting fixture housing. The LED lighting sheet may be coupled to the mandrel and rotated therearound in the retracted position. In some versions of those embodiments a Hall Effect sensor may sense revolutions of the mandrel. In some other versions of those embodiments the controller may control the revolutions of the mandrel and selectively extinguish each of the groups based on the revolutions.

Generally, in still another aspect, the invention relates to a method for selectively actuating LEDs as they are retracted into and protracted out of a retractable lighting fixture housing is provided. The method includes the steps of: electronically determining which of a plurality of LED groupings on a LED lighting sheet are in a retracted position substantially within a retractable lighting fixture housing; electronically determining which of the plurality of LED groupings on the LED lighting sheet are in an extended position substantially outside the retractable lighting fixture housing; electronically extinguishing the LED groupings determined to be in the retracted position; and electronically illuminating the LED groupings determined to be in the extended position.

Also, in still another aspect, the invention relates to a retractable lighting fixture that includes a housing and a flexible multilayer lighting sheet retractably retainable within the lighting fixture housing. The multilayer lighting sheet is movable between a retracted position at least partially retracted within the lighting fixture housing and an extended position more protracted from the lighting fixture housing than the retracted position. The multilayer lighting sheet has a LED layer and an optical layer at least selectively over the LED layer. The LED layer includes a plurality of LEDs selectively generating a light output and the optical layer intersects and transmits at least some of the light output. Portions of the LED layer and the optical layer are in an expanded unrolled state when in the extended position and in a compressed rolled state when in the retracted position.

In some embodiments, the LED layer and the optical layer are rolled separately from one another when in the retracted position. In other embodiments, the LED layer and the optical layer are commonly rolled and in contact in the compressed relation.

In some embodiments, the distance between the LED layer and the optical layer in the extended position is greater than the distance between the LED layer and the optical layer in the retracted position.

The lighting fixture may further include a mandrel within the retracted lighting fixture housing and the LED layer may be coupled to the mandrel and rotated therearound in the retracted position. In some versions of those embodiments the lighting fixture further includes a second mandrel within the retracted lighting fixture housing and the optical layer may coupled to the second mandrel and rotated therearound in the retracted position. The mandrel and the second mandrel are optionally movable relative to one another.

In some embodiments, the multilayer lighting sheet includes a second optical layer over the LED layer that is on an opposite side of the LED layer than the optical layer In some embodiments, the LED layer, the optical layer, and the second optical layer are all rolled separately from one another when in the retracted position.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Generally, Applicants have recognized and appreciated that it would be beneficial to provide a LED-based lighting fixture having a retractable lighting sheet. In view of the foregoing, various embodiments and implementations of the present invention are directed to a LED-based lighting fixture employing a retractable LED lighting layer with one or more optional optical layers provided over the LED lighting layer. The optical sheet(s) and the LED lighting sheet may optionally be movable relative to one another between at least being in an expanded spaced relation to one another and a compressed relation to one another. In some embodiments one or more LEDs on the LED lighting sheet may be individually controllable and such LEDs may be selectively extinguished when they are in a retracted position.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. For example, throughout the description various embodiments are discussed in combination with certain lighting fixtures that may be configured for certain applications. However, one of skill in the art having had the benefit of the present disclosure will recognize and appreciate that the principles hereof may be implemented in other lighting fixtures that may be configured for other applications. Moreover, descriptions of well-known apparatuses and methods may be omitted so as to not obscure the description of the representative embodiments. Such methods and apparatuses are clearly within the scope of the claimed invention.

Figure 1:
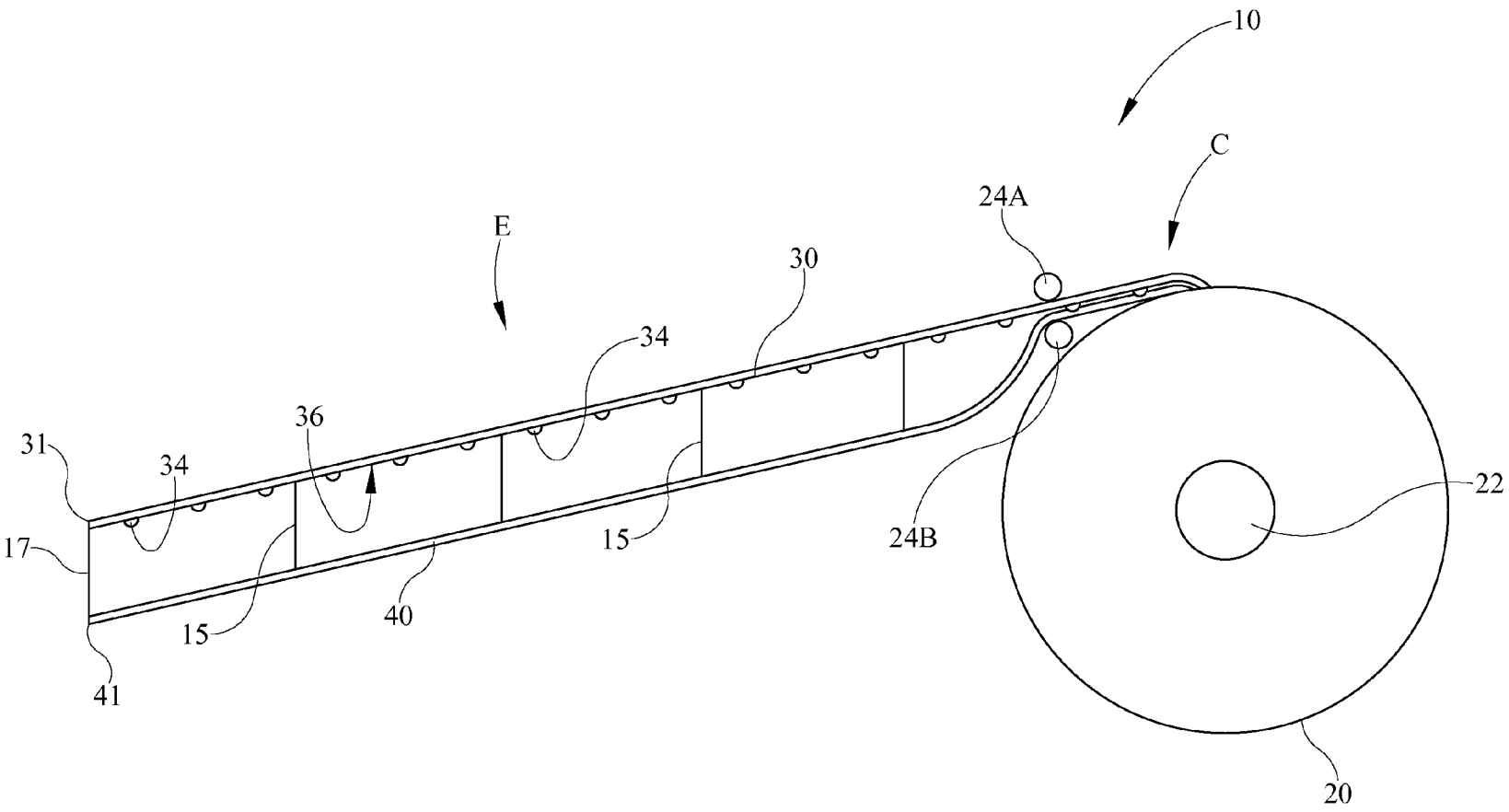
FIG. 1 illustrates a side view of a first embodiment of a retractable lighting fixture; a side of a multilayer lighting sheet is removed to better illustrate aspects of the multilayer lighting sheet.

Referring initially to FIG. 1, a side view of a first embodiment of a retractable lighting fixture 10 is illustrated. The lighting fixture 10 includes a housing 20 and a flexible multilayer lighting sheet retractably retainable within the housing 20. The illustrated multilayer lighting sheet includes a LED layer 30 and an optical layer 40 over the LED layer 30. The multilayer lighting sheet is illustrated extending through an opening in the housing 20. A portion of the multilayer lighting sheet is located outside of the housing 20 and is visible in FIG. 1. Another portion of the multilayer lighting sheet is retractably retained within the housing 20 and is not illustrated in FIG. 1. The portion of the multilayer lighting sheet retained within the housing 20 may optionally be wrapped around a mandrel 22 illustrated in FIG. 1. In alternative embodiments the mandrel 22 may be omitted. For example, in some embodiments the multilayer lighting sheet may be wrapped around itself. As described in additional detail herein, all or portions the multilayer lighting sheet may be selectively protracted out of the housing 20 to one or more desired static protracted positions. For example, the multilayer lighting sheet may be selectively protracted out of the housing 20 to a static fully extended position and/or one or more static positions that are not fully extended (such as the position shown in FIG. 1). Also, all or portions of the multilayer lighting sheet may be retracted within the housing 20 to one or more static desired retracted positions. For example, the multilayer lighting sheet may be retracted into the housing 20 to a static fully retracted position and/or one or more static positions that is not fully retracted (such as the position shown in FIG. 1).

A side of the multilayer lighting sheet is removed in FIG. 1 to better illustrate aspects of the multilayer lighting sheet. The side may be formed from a diffuse material, an opaque material, and/or a transparent material, or may be omitted in some embodiments. An end cap 17 is illustrated in FIG. 1 extending between the end 31 of the LED layer 30 and the end 41 of the optical layer 40. The end cap 17 may similarly be formed a diffuse material, an opaque material, and/or a transparent material, or may be omitted in some embodiments.

The LED layer 30 includes a plurality of LEDs 34 thereon and may optionally include electrical connections extending to the LEDs 34. In alternative embodiments, the electrical connections may be provided to the LEDs 34 separate from the LED layer 30. The LEDs 34 are all positioned such that a majority of light output therefrom is primarily directed toward the optical layer 40. The surface 36 surrounding the LEDs 34 may optionally be reflective to redirect any LED light incident thereon toward the optical layer 40. For example, a light reflective coating may be applied to the surface 36. The surface of the LED layer 30 opposite surface 36 may also optionally be reflective. For example, in some embodiments the lighting fixture 10 may be utilized as an awning and in some versions of those embodiments an upper reflective surface of the LED layer 30 may reflect sunlight away from the multilayer lighting sheet.

The optical layer 40 may be a flexible optical diffuser sheet. When spaced an appropriate distance from the LED layer 30, a diffusing optical layer 40 may help minimize the appearance of light-dot pattern from the LEDs 34 and/or may help mix light output from multiple colors of LEDs 34. The optical layer 40 may additionally or alternatively include a phosphor in some embodiments to alter the color of light emitted therethrough.

The optical layer 40 and the LED layer 30 are illustrated in an expanded spaced relation E to one another downstream of a pair of compression rollers 24A, 24B and in a compressed relation C to one another upstream of the compression rollers 24A, 24B. The LED layer 30 and/or the optical layer 40 may be stretched away from the housing 20 and maintained in a desired protracted position utilizing, for example, mechanical awning parts such as folding awning arms. One of ordinary skill in the art, having had the benefit of the present disclosure, will recognize and appreciate that folding awning arms and/or other stiffeners may be applied to the lighting fixture 10 to maintain the multilayer lighting sheet at a desired protracted position.

A plurality of interspacing structures 15 extend between the optical layer 40 and the LED layer 30 and help maintain desired spacing between the two when they are in expanded spaced relation E. In some embodiments one or more of the interspacing structures 15 may be biased to an expanded state. For example, in some embodiments the interspacing structures 15 may include foam structures, springs, and/or hydraulic structures that are biased to an expanded state. In some embodiments one or more of the interspacing structures 15 may be non-biased. For example, in some embodiments the interspacing structures 15 may include strings and/or non-biased bars. The expanded spaced relation E distance between the LED layer 30 and the optical layer 40 may be fixed in some embodiments. In other embodiments the expanded spaced relation E distance may be variable thereby enabling, inter alia, varying optical effect, variable color temperature, or other variable light output characteristics. For example, in some embodiments the height of some or all of the sidewalls and/or endcap 17 may be adjustable by a user (e.g., utilizing snaps, zippers, interchangeable sidewalls/endcaps) to thereby limit the maximum distance that all or portions of LED layer 30 and optical layer 40 may be from one another.

A pair of compression rollers 24A, 24B are provided adjacent an entrance to the housing 20 and compress portions of LED layer 30 and optical layer 40 toward one another into compressed relation C prior to entering the housing 20. The compression rollers 24A, 24B may optionally be coupled to the lighting fixture housing 20. The multilayer lighting sheet may optionally be coupled to and wrapped around a mandrel 22 in compressed relation C within the housing 20. The compression rollers 24A, 24B may be provided within the housing 20 in alternative embodiments. As discussed herein, as the multilayer lighting sheet moves downstream of the compression rollers 24A, 24B, the LED layer 30 and the optical layer 40 move into expanded spaced relation E relative to one another. As the multilayer lighting sheet is retracted back into the housing 20, the compression rollers 24A, 24B compress the LED layer 30 and the optical layer 40 into compressed relation C relative to one another. The layers 30, 40 are maintained in compressed relation C as they are wrapped around mandrel 22 within the housing 20.

The lighting fixture 10 may be particularly suited for use as a retractable awning. For example, during the day the multilayer lighting sheet may be partially or fully protracted and provide shade from the sun. In the evening, a glowing light surface may be provided by the multilayer lighting sheet to provide sufficient light for activities under the awning and/or to provide heat under the awning (e.g., utilizing infrared LEDs).

Figure 2:
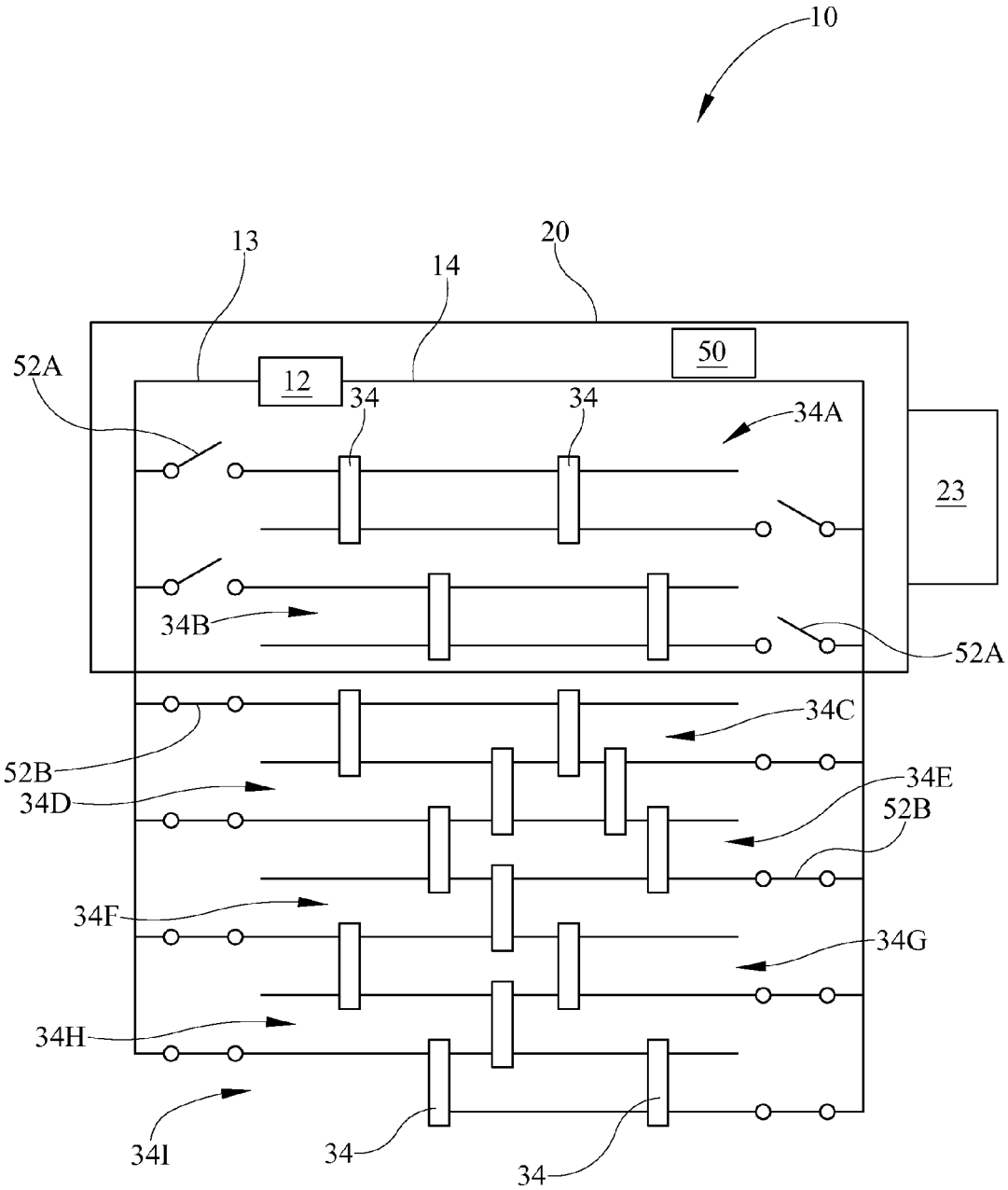
FIG. 2 illustrates a schematic view of the retractable lighting fixture of FIG. 1 showing aspects of a LED control system thereof.

Referring now to FIG. 2, a schematic view of the retractable lighting fixture 10 of FIG. 1 is illustrated, showing aspects of a LED control system thereof. The multilayer lighting sheet is more retracted in FIG. 2 than it is in FIG. 1. In particular, seven separate rows of LEDs 34 are protracted from the housing 20 in FIG. 2 (34C-I) whereas sixteen rows are protracted from the housing 20 in FIG. 1. Portions of the remainder of the lighting sheet compressed within the housing 20 are visible in FIG. 2 (LED rows 34A and 34B) and other portions compressed within the housing 20 are hidden in the view of FIG. 2 (e.g., additional LED rows).

A power source 12 is retained within the housing 20 and includes a positive output 13 and a negative output 14. In some embodiments the power source 12 includes one or more LED drivers electrically coupled to a mains power supply. In other embodiments a battery, solar panel, and/or other external power supply may be utilized. In alternative embodiments the power source 12 may be located outside of the housing 20. The positive output 13 extends along one side of the LED rows 34A-I and the negative output 14 extends along the opposite side of the LED rows 34A-I. Each of LED rows 34A-E, 34G, and 34I include two LEDs 34 and LED rows 34F and 34H each include a single LED 34. The positive output 13 and negative output 14 are supplied to appropriate leads of LEDs 34 of LED groups 34C-I via closed switches 52B. The positive output 13 and negative output 14 are prevented from reaching leads of LEDs 34 of LED groups 34A and 34B as a result of open switches 52A. Accordingly, light is generated by those LEDs 34 that are outside of the housing 20 and is not generated by those LEDs that are within the housing 20. Extinguishing LEDs 34 when they are within the housing 20 may conserve energy, preserve the life of some of the LEDs 34, and/or may reduce heat buildup within the housing 20.

In some embodiments, the state of the switches 52A, 52B may be controlled via controller 50. For example, in some embodiments wiring may extend between controller 50 and the individual switches 52A, 52B to control the state thereof. Also, for example, in some embodiments the controller 50 may send a wireless control signal to the switches 52A, 52B to control the state thereof. The controller 50 may utilize one or more methods to determine which of the switches should be open and which should be closed. For example, in one implementation the controller 50 may be electronically coupled to a motor 23. The motor 23 may be electrically coupled to power source 12, mains power, or another power source and may drive mandrel 22 (not shown in FIG. 2) and/or one or more awning arms. The controller 50 may dictate the output of motor 23 and correlate the dictated output to a determination of which LED groupings 34A-I are within the housing 20 and which LED groupings 34A-I are external to the housing 20. For example, the controller 50 may recognize that for each second the motor 23 is activated, one row of LEDs 34 will be either protracted or retracted (depending on the motor direction) from the housing 20 and send appropriate switch control signals based upon the amount of time motor 23 is activated and the activation direction.

Also, for example, in another implementation the controller 50 may be electrically coupled to one or more sensors that directly or indirectly determine the position of one or more LEDs 34. For example, a sensor (e.g., hall effect sensor) may be provided adjacent motor 23 and/or mandrel 22 to measure rotations thereof. The controller 50 may be in electrical communication with such a sensor and analyze the number and direction of rotations to determine which LEDs 34 are retracted into the housing 20 and should be extinguished. Also, for example, a distance sensor (e.g., ultrasound, laser) may be positioned to measure the distance between the housing 20 and the end 31 of the LED layer 30. The controller 50 may be in electrical communication with such a sensor and utilize this distance to determine which LEDs 34 are retracted into the housing 20 and should be extinguished. Also, for example, one or more optical sensors may be positioned on the multilayer lighting sheet to detect ambient light (or the absence thereof). The controller 50 may be in electrical communication with such sensors and determine which sensors are in the housing 20 and which are out of the housing 20. Based on this determination, the controller 50 may appropriately illuminate or extinguish one or more LEDs 34 associated with each optical sensor. The controller 50 may also control the light output of the one or more illuminated LEDs 34 based at least in part on the ambient light level detected by the exposed optical sensors. Also, for example, one or more magnetic field sensors may be positioned on the multilayer lighting sheet to detect a magnetic field (or the absence thereof). A magnetic field may be present within the housing 20 (e.g., via a permanent magnet and/or an electromagnet). The controller 50 may be in electrical communication with such sensors and determine which sensors are in the housing 20 and which are out of the housing 20 based on the magnetic field measurement. Based on this determination, the controller 50 may appropriately illuminate or extinguish one or more LEDs associated with each magnetic field sensor.

In other embodiments, the controller 50 may be omitted. For example, in some embodiments the switches 52A, 52B may be coupled directly to a mechanical structure that when pressed causes the switches 52A, 52B to be opened. The mechanical structure may be pressed via contact with the optical layer 40 when the LED layer 30 and the optical layer 40 are in compressed relation C relative to one another, thereby extinguishing LEDs 34 associated therewith. Also, for example, in some embodiments, the switches 52A, 52B may be coupled directly to a magnetic mechanical structure that when in a first position causes the switches 52A, 52B to be opened. The magnetic mechanical structure may be moved to the first position via presence within a magnetic field of at least a predetermined strength. Such a magnetic field may be present within the housing 20. Accordingly, when the switches 52A, 52B are within the housing 20 they will be opened, thereby extinguishing LEDs 34 associated therewith. Also, for example, in some embodiments the switches 52A, 52B may be coupled directly to a mechanical structure that is pivoted in a first direction by compression rollers 24A, 24B and/or an entrance to housing 20 when passing thereby during retraction and pivoted in a second direction when passing thereby during protraction. The first direction causes the switches 52A, 52B to be opened and the second direction causes the switches 52A, 52B to be closed.

Although specific sensors and their interactions with other aspects of the LED lighting control system are described herein, one of ordinary skill in the art, having had the benefit of the present disclosure, will recognize and appreciate that other sensors may additionally or alternatively be utilized to determine the relative position of one or more LEDs 34. Moreover, one will recognize and appreciate that such sensors may be in communication with a controller that controls separate switches corresponding to one or more LEDs or may be in communication directly with switches corresponding to one or more LEDs.

Although FIG. 2 illustrates at least a pair of LEDs 34 each being commonly controlled by a single switch, one of ordinary skill in the art having had the benefit of the present disclosure will recognize and appreciate that in alternative embodiments more or fewer LEDs 34 in a lighting fixture may be commonly lit and extinguished. For example, in some embodiments one or more LEDs may be individually lit and extinguished. Also, for example, in some embodiments multiple rows of LEDs may be commonly lit and extinguished. For example, in the embodiment of FIG. 2, LED rows 34C and 34D may be commonly lit and extinguished via actuation of switch 52B interposed between negative output 14 and negative leads of LEDs 34 of LED rows 34C and 34D. Also, for example, LED rows 34D and 34E may be commonly lit and extinguished via actuation of switch 52B interposed between positive output 13 and positive leads of LEDs 34 of LED rows 34D and 34E.

Figure 3:
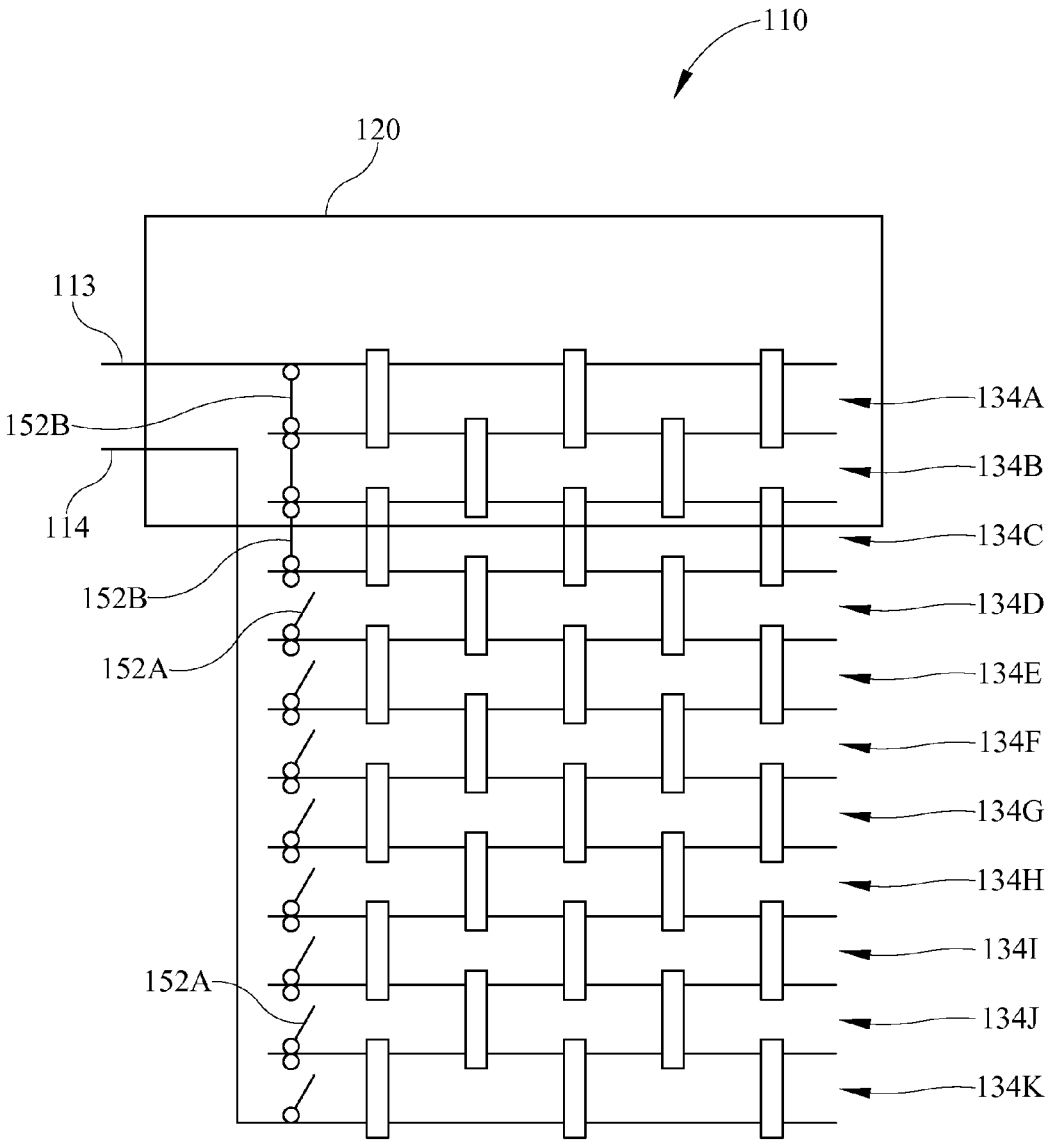
FIG. 3 illustrates a schematic view of a second embodiment of a retractable lighting fixture showing aspects of a LED control system thereof.

Referring to FIG. 3, a schematic view of a second embodiment of a retractable lighting fixture 110 showing aspects of a LED control system thereof is illustrated. Eleven separate rows of LEDs 34 of a lighting sheet are illustrated in FIG. 3. Eight of the rows of LEDs 34 on the lighting sheet are fully protracted from a housing 120 (LED rows 134D-K). Portions of the remainder of the lighting sheet located within the housing 120 are visible in FIG. 3 (LED rows 134A-C) and other portions that may be located within the housing 120 are hidden in the view of FIG. 3 (e.g., other LED rows).

A positive power source output 113 and a negative power source output 114 extend into the housing 120. In some embodiments the outputs may extend from an external power source that includes one or more current limiting LED drivers electrically coupled to a mains power supply. In alternative embodiments the power source may be located within the housing 120. The positive output 113 extends along one end of the LED rows 134A-K and the negative output 114 extends along the opposite end of the LED rows 134A-K. Each LED row 34A, C, E, G, I, and K includes three LEDs 134 connected to one another in parallel and each LED row 34B, D, F, H, and J includes two LEDs 134 connected to one another in parallel. The LED rows 134A-K are connected to one another in serial. The positive output 113 is supplied to appropriate leads of LEDs 134 of LED row 134A and the negative output 114 is supplied to appropriate leads of LEDs 134 of LED row 134K. By closing the switches 152B, there is no voltage difference over the LEDs 134 of LED groups 134A, 134B, and 134C. Hence, those LEDs 134 will not emit light. The voltage difference is created over the groups 134D-K and the current generated by the power source should be limited accordingly. Thus, in the illustrated arrangement light is generated by those LEDs 134 that are outside of the housing 120 and is not generated by those LEDs 134 that are within the housing 120.

In some embodiments, the state of the switches 152A, 152B may be controlled via a controller, one or more mechanical structures, and/or one or more sensors in a manner similar to that described with respect to FIG. 2. For example, in some embodiments the switches 152A, 152B may be coupled directly to a mechanical structure that when pressed causes the switches 152A, 152B to be closed. The mechanical structure may be pressed via contact with structure as the lighting sheet is retracted into the housing 120, thereby extinguishing LEDs 134 associated therewith. Although FIG. 3 illustrates both pairs and threes of LEDs 34 being commonly controlled by a single switch, one or ordinary skill in the art having had the benefit of the present disclosure will recognize and appreciate that in alternative embodiments more or fewer LEDs 134 in a lighting fixture may be commonly lighted and extinguished.

Figure 4A:
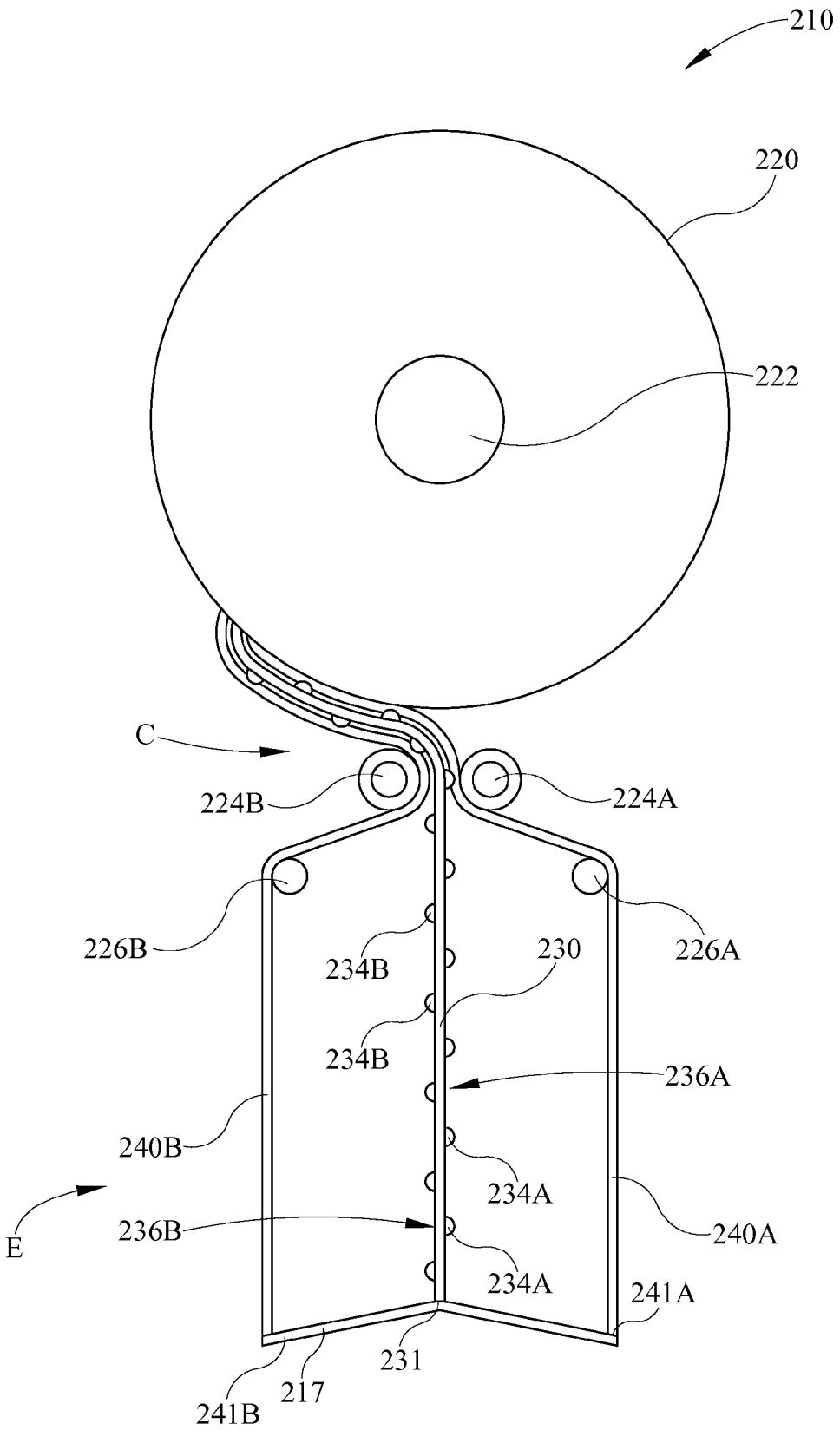
FIG. 4A illustrates a side view of a third embodiment of a retractable lighting fixture; a side of a multilayer lighting sheet is removed to better illustrate aspects of the multilayer lighting sheet; expansion rollers of the retractable lighting fixture are illustrated in a first position.

Referring to FIG. 4A, a side view of a third embodiment of a retractable lighting fixture 210 is illustrated. The lighting fixture 210 includes a housing 220 and a flexible multilayer lighting sheet retractably retainable within the housing 220. The illustrated multilayer lighting sheet includes a LED layer 230 and an optical layer 240A, 240B on each side of the LED layer 230. The multilayer lighting sheet is illustrated extending through an opening in the housing 220. A portion of the multilayer lighting sheet is located outside of the housing 220 and is visible in FIG. 4A. Another portion of the multilayer lighting sheet is retractably retained within the housing 220 and is not illustrated in FIG. 4A. The portion of the multilayer lighting sheet retained within the housing 220 may optionally be wrapped around a mandrel 222. All or portions the multilayer lighting sheet may be selectively protracted out of the housing 220 to one or more desired static protracted positions. For example, the multilayer lighting sheet may be selectively protracted out of the housing 220 to a static fully extended position and/or one or more static positions that are not fully extended (such as the position shown in FIG. 4A). Also, all or portions of the multilayer lighting sheet may be retracted within the housing 220 to one or more static desired retracted positions.

A side of the multilayer lighting sheet is removed in FIG. 4A to better illustrate aspects of the multilayer lighting sheet. The side may be formed from a diffuse material, an opaque material, and/or a transparent material, or may be omitted in some embodiments. An end cap 217 is illustrated in FIG. 4A extending between the end 231 of the LED layer 230 and the ends 241A, 241B of the optical layers 240A, 240B. The end cap 217 may similarly be formed of a diffuse material, an opaque material, and/or a transparent material, or may be omitted in some embodiments.

The LED layer 230 includes a plurality of LEDs 234A on a first side thereof and also includes a plurality of LEDs 234B on a second side thereof. The LED layer may optionally include electrical connections extending to the LEDs 234A, 234B. The LEDs 234A are all positioned such that a majority of light output therefrom is primarily directed toward the optical layer 240A and the LEDs 234B are all positioned such that a majority of light output therefrom is primarily directed toward the optical layer 240B. The surfaces 236A, 236B surrounding the LEDs 234A, 234B may optionally be reflective to redirect any LED light incident thereon toward the optical layers 240A, 240B.

The optical layers 240A and 240B may be flexible optical diffuser sheets in some embodiments. The optical layers 240A and 240B may additionally or alternatively include a phosphor in some embodiments to alter the color of light emitted therethrough. In some embodiments, the optical layers 240A and 240B may have a substantially similar configuration. In other embodiments, the optical layers 240A and 240B may have distinct configurations. For example, one of the optical layers 240A, 240B may have prisms thereon to direct light in a first general direction and the other of the optical layers 240A, 240B may have prisms thereon to direct light in a second general direction.

The optical layers 240A, 240B and the LED layer 230 are illustrated in an expanded spaced relation E to one another downstream of a pair of compression rollers 224A, 224B and a pair of expansion rollers 226A, 226B. The optical layers 240A, 240B and the LED layer 230 are illustrated in a compressed relation C to one another upstream of the compression rollers 224A, 224B and expansion rollers 226A, 226B. The LED layer 230 and/or the optical layers 240A, 240B may be stretched away from the housing 220 and maintained in a desired protracted position utilizing, for example, gravity and the weight of the multilayer lighting sheet. One of ordinary skill in the art, having had the benefit of the present disclosure, will recognize and appreciate that mechanical features may optionally be applied to the lighting fixture 210 to maintain the multilayer lighting sheet at a desired protracted position.

The pair of compression rollers 224A, 224B are provided adjacent an entrance to the housing 220 and compress portions of LED layer 230 and optical layers 240A, 240B toward one another into compressed relation C prior to entering the housing 220. As the multilayer lighting sheet moves downstream of the compression rollers 224A, 224B, the optical layers 240A, 240B move around expansion rollers 226A, 226B, which move the optical layers 240A, 240B into expanded spaced relation E relative to one another. As the multilayer lighting sheet is retracted back into the housing 220, the compression rollers 224A, 224B compress the LED layer 230 and the optical layer 240 into compressed relation C relative to one another. The layers 230, 240A, and 240B are maintained in compressed relation C as they are wrapped around mandrel 222 within the housing 220. The compression rollers 224A, 224B and/or the expansion rollers 226A, 226B may optionally be coupled to the lighting fixture housing 220. The compression rollers 224A, 224B and/or expansion rollers 226A, 226B may be provided more proximal to and/or within the housing 220 in alternative embodiments.

Figure 4B:
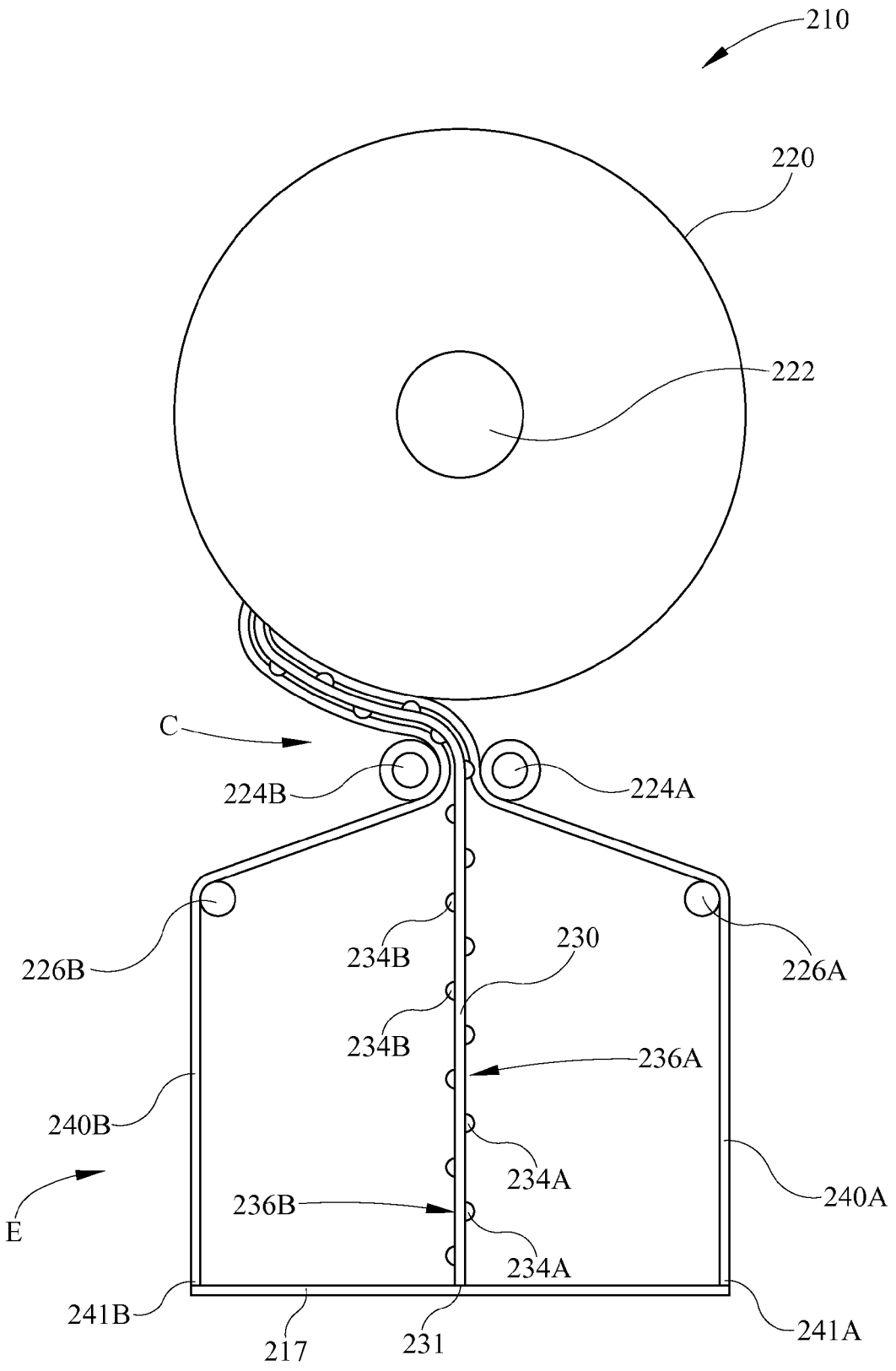
FIG. 4B illustrates a side view of the third embodiment of the retractable lighting fixture of FIG. 4A; the expansion rollers of the retractable lighting fixture are illustrated in a second position in FIG. 4B.

FIG. 4B illustrates a side view of the third embodiment of the retractable lighting fixture 210 of FIG. 4A. The expansion rollers 226A, 226B of the retractable lighting fixture are illustrated in a second position in FIG. 4B, thereby causing the optical layers 240A and 240B to be spaced apart from the LED layer 230 more so than in FIG. 4A. The end cap 217 has flattened out from its V-shape configuration of FIG. 4A to accommodate the increased spacing. Although two positions are shown in FIGS. 4A and 4B, one of ordinary skill in the art, having had the benefit of the present disclosure, will recognize and appreciate that the expansion rollers 226A, 226B may optionally be adjusted to a number of other positions. Moreover, in various embodiments the expansion rollers 226A, 226B may be adjustable independently of one another. For example, in some embodiments the expansion rollers 226A, 226B may be adjusted such that optical layer 240A is a first distance away from LED layer 230 and optical layer 240B is a distinct second distance away from LED layer 230. A user interface may optionally be provided to enable a user to manipulate the positioning of expansion rollers 226A, 226B. For example, in some embodiments a user may utilize the user interface to select a desired lighting effect and the expansion rollers 226A, 226B may be adjusted accordingly to a predetermined spacing corresponding to such effect.

The LEDs 234 of the second embodiment of the lighting fixture 210 may optionally be controlled utilizing one or more of the methods and/or apparatus described herein. For example, the LEDs may be controlled to extinguish LEDs 234 that are within the housing 220 and/or that are upstream of the compression rollers 224A, 224B. Also, for example, some or all of the LEDs 234A, and/or 234B may be controlled in order to generate a variety of colors and color-changing lighting effects.

The lighting fixture 210 may be particularly suited for utilization as a retractable and optionally portable illuminating surface. For example, the lighting fixture 210 may be utilized as a divider to separate spaces, as a light source hung from the top of a tent or other location, and/or in other implementations.

Figure 5:
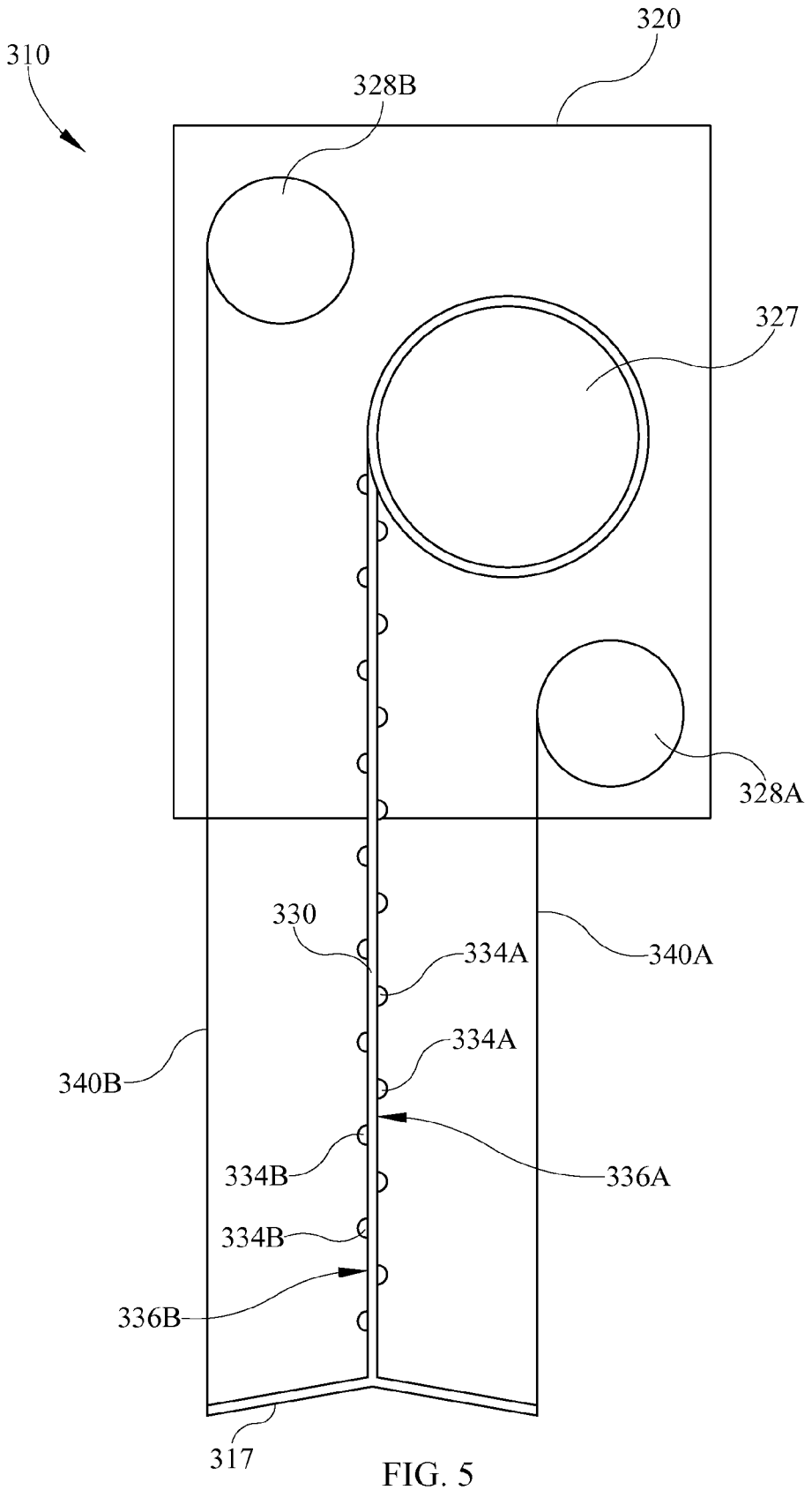
FIG. 5 illustrates a side section view of a fourth embodiment of a retractable lighting fixture.

FIG. 5 illustrates a side section view of a fourth embodiment of a retractable lighting fixture 310. The lighting fixture 310 includes a housing 320 and a flexible multilayer lighting sheet retractably retainable within the housing 320. The illustrated multilayer lighting sheet includes a LED layer 330 and an optical layer 340A, 340B on each side of the LED layer 330. The multilayer lighting sheet is illustrated extending through an opening in the housing 320. A portion of the multilayer lighting sheet is located outside of the housing 320 and is visible in FIG. 5. Another portion of the multilayer lighting sheet is retractably retained within the housing 320. The portion of the multilayer lighting sheet retained within the housing 320 is hanging from and/or wrapped around three separate mandrels: optical layer mandrels 328A, 328B and LED layer mandrel 327. The optical layer 340A is coupled to the optical layer mandrel 328A, the optical layer 340B is coupled to the optical layer mandrel 328B, and the LED layer 330 is coupled to the LED layer mandrel 327. All or portions the multilayer lighting sheet may be selectively protracted out of the housing 320 to one or more desired static protracted positions via rotation of the layers 330, 340A, and 340B about the respective mandrels 327, 328A, and 328B. In alternative embodiments one or more of the mandrels 327, 328A, and 328B may be omitted. For example, in some embodiments one or more of the layers 330, 340A, and 340B may be wrapped about themselves within the housing 320.

The LED layer 330 includes a plurality of LEDs 334A on a first side thereof and also includes a plurality of LEDs 334B on a second side thereof. The LED layer may optionally include electrical connections extending to the LEDs 334A, 334B. The LEDs 334A are all positioned such that a majority of light output therefrom is primarily directed toward the optical layer 340A and the LEDs 334B are all positioned such that a majority of light output therefrom is primarily directed toward the optical layer 340B. The surfaces 336A, 336B surrounding the LEDs 334A, 334B may optionally be reflective to redirect any LED light incident thereon toward the optical layers 340A, 340B. An end cap 317 is illustrated in FIG. 5 extending between the ends of the LED layer 330 and the optical layers 340A, 340B.

The LED layer 330 and/or the optical layers 340A, 340B may be stretched away from the housing 320 and maintained in a desired protracted position utilizing, for example, gravity and the weight of the multilayer lighting sheet. In some embodiments one or more of the LED layer mandrel 327 and the optical mandrels 328A, 328B may be movable horizontally and/or vertically. For example, optical mandrels 328A, 328B may be movable horizontally closer to or farther away from one another to thereby alter the spacing of the LED layers 340A, 340B relative to one another and relative to LED layer 330. Also, for example, the LED layer mandrel 327 may be movable horizontally to alter the spacing of the LED layer 330 relative to the optical layers 340A, 340B.

The LEDs 334 of the second embodiment of the lighting fixture 310 may optionally be controlled utilizing one or more of the methods and/or apparatus described herein. For example, the LEDs 334 may be controlled to extinguish LEDs 334 that are within the housing 320. Also, for example, some or all of the LEDs 334A, and/or 334B may be controlled in order to generate a variety of colors and color-changing lighting effects.

Figure 6:
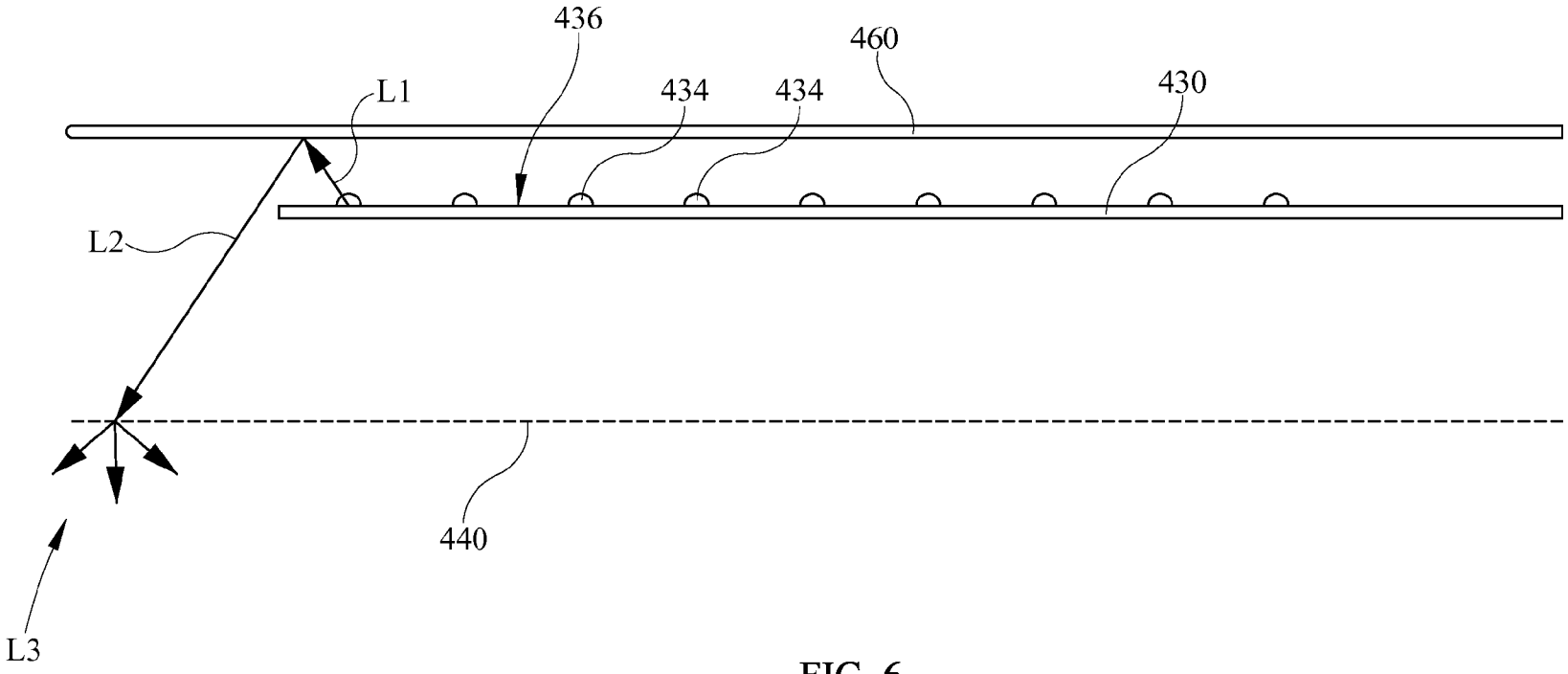
FIG. 6 illustrates a side section view of an embodiment of a multilayer lighting sheet.

FIG. 6 illustrates a section view of an embodiment of a multilayer lighting sheet that may be utilized in combination with lighting fixtures described herein. The lighting sheet includes a LED layer 430 having a plurality of LEDs 434 thereon. The LEDs 434 are directed toward a reflecting layer 460 that reflects light output from the LEDs 434 toward a diffusing optical layer 440. The surface 436 surrounding the LEDs 434 may optionally be reflective to redirect any LED light incident thereon from the LEDs 434 toward the reflecting layer 460 in some embodiments. In other embodiments the surface 436 may optionally be transparent to transmit any light incident thereon from the LEDs 434 toward the optical layer 440. The LED layer 430 may optionally include one or more openings therein to allow the light reflected by reflecting layer 460 to pass through to the optical layer 440. For example, in some embodiments the LED layer 430 may include a plurality of LED strips each containing a column of LEDS, with open space provided between each of the LED strips. An exemplary light ray is illustrated emanating from one of the LEDs 434 in FIG. 6. The light ray, at L1, travels from the LED 434 to the reflective surface 460, where it is reflected, at L2, toward optical layer 440. In alternative embodiments the reflective surface 460 may be textured such that the reflection is diffuse. The light ray, at L3, passes through the optical layer 440 where it is diffused.

Figure 7B:
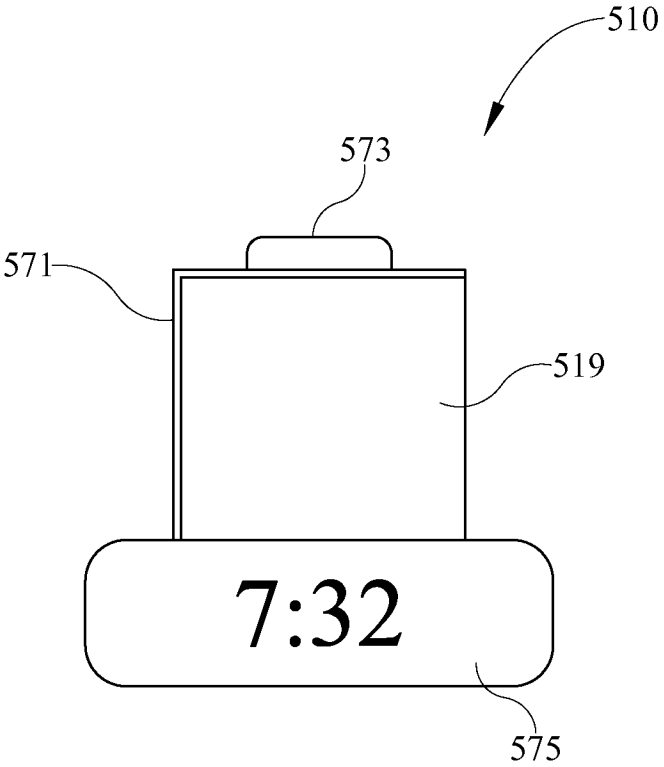
FIG. 7B illustrates the fifth embodiment of the retractable lighting fixture with the multilayer lighting sheet in a fully protracted position.
Figure 7A:
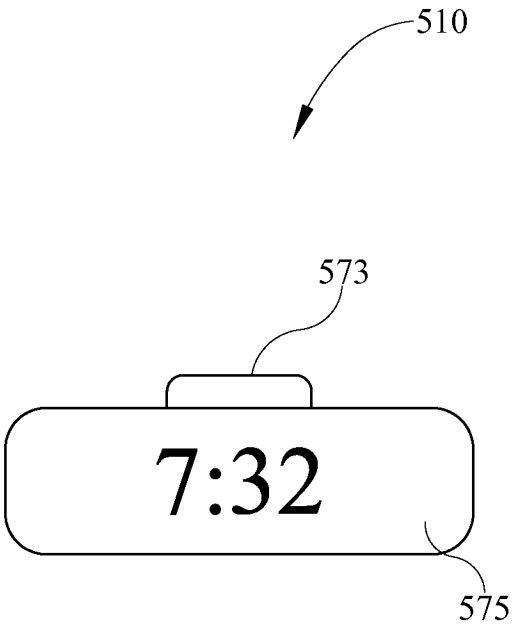
FIG. 7A illustrates a fifth embodiment of a retractable lighting fixture with a multilayer lighting sheet thereof in a fully retracted position.

Referring now to FIGS. 7A and 7B, a fifth embodiment of a retractable lighting fixture 510 is illustrated. A multilayer lighting sheet 519 thereof is illustrated in a fully retracted position in FIG. 7A and a fully protracted position in FIG. 7B. The lighting fixture 510 includes a housing 575 that has a face which displays the time. The fixture 510 also includes a handle 573 that is coupled to a telescoping arm 571 that may be contracted to enable the lighting sheet 519 to retract partially or fully (as illustrated in FIG. 7A) within the housing 575. The arm 571 may also be extended to a fully protracted position (as illustrated in FIG. 7B), or to a desired position between fully retracted and fully protracted. In alternative embodiments the telescoping arm 571 may be replaced with a rotatable arm.

The multilayer lighting sheet 519 may incorporate one or more LED layers and/or optical layers as described herein. Moreover, the LEDs of the LED layer(s) may optionally be controlled utilizing one or more of the methods and/or apparatus described herein. For example, the LEDs may be controlled to extinguish LEDs that are within the housing 575. Also, for example, in some embodiments the LEDs on the protracted multilayer sheet 519 can be driven row by row to create a rising wake up light pattern at a preset alarm time. Also, for example, some or all of the LEDs may be controlled in order to generate a variety of colors and color-changing lighting effects.

Certain embodiments of the lighting fixture described herein may be implemented in window blinds. The lighting sheet may be protracted out of the housing of such a lighting fixture to block exterior light and/or provide privacy while also optionally simultaneously providing light to an interior area. The lighting sheet may also be retraced into the housing to provide a view of the exterior and/or to enable exterior light to be provided in the interior area.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in the claims are provided merely for convenience and should not be construed as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A retractable lighting fixture, comprising:

a housing;

a flexible LED lighting sheet retractably retainable within said housing, said LED lighting sheet movable between a retracted position at least partially retracted within said lighting fixture housing and an extended position protracted from said lighting fixture housing more than said retracted position; said LED lighting sheet having a plurality of LEDs selectively electrically connected to a power supply;

a plurality of electrical switches, each of said switches electrically interposed between at least one of said LEDs and said power supply; said switches actuable between at least a first state and a second state;

wherein in said first state each of said switches enables electrical interconnectivity between said power supply and LEDs associated therewith;

wherein in said second state each of said switches prevents electrical interconnectivity between said power supply and LEDs associated therewith;

wherein each of said switches is in said first state when LEDs associated therewith are protracted from said lighting fixture housing;

wherein each of said switches is in said second state when LEDs associated therewith are retracted within said lighting fixture housing; and wherein each of said switches is configured such that an initial protraction out of said lighting fixture housing of one or more LEDs associated with the respective switch prompts the respective switch to enter said first state.

2. The retractable lighting fixture of claim 1, wherein said first state of said switches is an open state.

3. The retractable lighting fixture of claim 1, wherein said first state of said switches is a closed state.

4. The retractable lighting fixture of claim 3, wherein said power supply is a current limiting power supply.

5. The retractable lighting fixture of claim 1, further comprising a controller in electrical communication with said switches and individually directing said switches between said first state and said second state.

6. The retractable lighting fixture of claim 5, further comprising at least one sensor in electrical communication with said controller, said sensor sensing the position of said LED lighting sheet.

7. The retractable lighting fixture of claim 6, wherein said sensor includes a hall effect sensor.

8. The retractable lighting fixture of claim 7, wherein the lighting fixture further comprises a mandrel within said retracted lighting fixture housing, said LED lighting sheet coupled to said mandrel and rotated therearound in said retracted position, wherein said hall effect sensor senses revolutions of said mandrel.

9. The retractable lighting fixture of claim 6, wherein said sensor includes a plurality of photo sensors coupled to said LED lighting sheet.

10. The retractable lighting fixture of claim 1, wherein at least some of said switches each include structure moving a respective of said switches into said first state when LEDs associated therewith are protracted from said lighting fixture housing and into said second state when LEDs associated therewith are retracted within said lighting fixture housing.

11. A method of selectively actuating LEDs as they are retracted into and protracted out of a retractable lighting fixture housing, comprising:

electronically determining which of a plurality of LED groupings on a LED lighting sheet are in a retracted position substantially within a retractable lighting fixture housing;

electronically determining which of said plurality of LED groupings on said LED lighting sheet are in an extended position substantially outside said retractable lighting fixture housing;

electronically extinguishing said LED groupings determined to be in said retracted position;

electronically illuminating said LED groupings determined to be in said extended position; and wherein said LED groupings determined to be in said protracted position are first groupings, wherein the electrically illuminating comprises electrically illuminating the first groupings, and wherein an initial protraction out of said lighting fixture housing of said first groupings prompts the electronically illuminating the first groupings.

12. A retractable lighting fixture, comprising:

a lighting fixture housing;

a flexible multilayer lighting sheet retractably retainable within said lighting fixture housing, said multilayer lighting sheet movable between a retracted position at least partially retracted within said lighting fixture housing and an extended position more protracted from said lighting fixture housing than said retracted position; said multilayer lighting sheet having a LED layer and an optical layer at least selectively over said LED layer, said LED layer including a plurality of LEDs selectively generating a light output, said optical layer intersecting and transmitting at least some of said light output;

wherein portions of said LED layer and said optical layer are in an unrolled state when in said extended position and in a rolled state when in said retracted position, wherein said LED layer and said optical layer are rolled separately from one another when in said retracted position; and wherein said LED layer and said optical layer are rolled separately from one another into separate rolls when in said retracted position.

13. The retractable lighting fixture of claim 12, wherein the distance between said LED layer and said optical layer in said extended position is greater than the distance between said LED layer and said optical layer in said retracted position.

14. The retractable lighting fixture of claim 12, further comprising a mandrel within said retracted lighting fixture housing, said LED layer coupled to said mandrel and rotated therearound in said retracted position.

15. The retractable lighting fixture of claim 14, further comprising a second mandrel within said retracted lighting fixture housing, said optical layer coupled to said second mandrel and rotated therearound in said retracted position, wherein said mandrel and said second mandrel are movable relative to one another.

16. A retractable lighting fixture, comprising:

a lighting fixture housing;

a flexible multilayer lighting sheet retractably retainable within said lighting fixture housing, said multilayer lighting sheet movable between a retracted position at least partially retracted within said lighting fixture housing and an extended position more protracted from said lighting fixture housing than said retracted position, said multilayer lighting sheet having a LED layer and an optical layer at least selectively over said LED layer, said LED layer including a plurality of LEDs selectively generating a light output, said optical layer intersecting and transmitting at least some of said light output;

wherein portions of said LED layer and said optical layer are in an expanded unrolled state when in said extended position and in a compressed rolled state when in said retracted position, wherein said multilayer lighting sheet includes a second optical layer over the LED layer, said second optical layer on an opposite side of said LED layer than said optical layer and wherein said LED layer, said optical layer, and said second optical layer are all rolled separately from one another when in said retracted position.

17. A retractable lighting fixture, comprising:

a lighting fixture housing;

a flexible multilayer lighting sheet retractably retainable within said lighting fixture housing, said multilayer lighting sheet movable between a retracted position at least partially retracted within said lighting fixture housing and an extended position more protracted from said lighting fixture housing than said retracted position, said multilayer lighting sheet having a LED layer and an optical layer at least selectively over said LED layer, said LED layer including a plurality of LEDs selectively generating a light output, said optical layer intersecting and transmitting at least some of said light output;

wherein portions of said LED layer and said optical layer are in an expanded unrolled state when in said extended position and in a compressed rolled state when in said retracted position, wherein the lighting sheet further comprises at least one mechanical spacer configured to form a spacing between the LED layer and the optical layer where the LED layer and the optical layer are in the expanded unrolled state, and wherein the LED layer is compressed toward the optical layer where the LED layer and the optical layer are in the compressed rolled state such that said spacing is reduced.

* * * * *